US010759034B2

(12) United States Patent
Dye

(10) Patent No.: US 10,759,034 B2
(45) Date of Patent: Sep. 1, 2020

(54) SYSTEMS AND METHODS FOR FASTENING A COMPONENT TO A BUILDING SUBSTRATE

(71) Applicant: James Hardie Technology Limited, Dublin (IE)

(72) Inventor: Thayne Dye, Upland, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 16/276,083

(22) Filed: Feb. 14, 2019

(65) Prior Publication Data

US 2019/0247989 A1 Aug. 15, 2019

Related U.S. Application Data

(60) Provisional application No. 62/631,320, filed on Feb. 15, 2018.

(51) Int. Cl.

| | |
|---|---|
| ***E04B 1/00*** | (2006.01) |
| ***B25C 7/00*** | (2006.01) |
| ***B25C 1/00*** | (2006.01) |
| *E04F 19/02* | (2006.01) |

(52) U.S. Cl.
CPC ..... *B25C 7/00* (2013.01); *B25C 1/008* (2013.01); *E04F 19/02* (2013.01)

(58) Field of Classification Search
CPC ..... B25C 1/001; B25C 1/00; B25C 1/008; B25C 7/00; B25C 13/00; F16B 45/00; F16B 45/06; A45F 5/00; A45F 2005/028; Y10S 224/904
USPC ..... 52/DIG. 1, 749.1, 749.12, 749.21
See application file for complete search history.

(56) References Cited

U.S. PATENT DOCUMENTS

| | | | | |
|---|---|---|---|---|
| 4,787,145 | A * | 11/1988 | Klicker | B27B 9/00 248/291.1 |
| 6,199,736 | B1 * | 3/2001 | Musarella | A45F 5/02 224/667 |
| 7,032,796 | B1 * | 4/2006 | Lin | B25C 5/1665 227/123 |
| 7,306,052 | B2 * | 12/2007 | Vahabi-Nejad | B25C 7/00 173/216 |

(Continued)

*Primary Examiner* — Chi Q Nguyen
(74) *Attorney, Agent, or Firm* — Knobbe Martens Olson & Bear, LLP

(57) ABSTRACT

Devices and methods for improved installation of trim, such as trim boards, to a building substrate. An alignment device configured for use with a nail gun is sized and shaped to facilitate repeatable and accurate angled nailing of trim boards at a desired nailing angle and height relative to a building substrate. The alignment device is sized and shaped to stably seat within an angle between a trim board and a building substrate such that a nail gun user can repeatedly drive nails at a regular angle and height through the side of the trim board and into the building substrate to nail the trim board to the building substrate without requiring the user to measure and/or visually determine the height and angle at which the nail will be driven. The alignment device includes a spacing section having a length that determines the spacing between the muzzle of the nail gun and the nail entry point, an entry angle section that determines the angle at which the nail will be driven, and an entry location section that determines the height at which the nail will be driven.

18 Claims, 8 Drawing Sheets

(56) References Cited

U.S. PATENT DOCUMENTS

| | | | | |
|---|---|---|---|---|
| 7,320,422 | B2 * | 1/2008 | Schell | B25C 1/005 173/170 |
| 8,556,148 | B2 * | 10/2013 | Schell | B25C 1/005 227/123 |
| 8,661,694 | B2 * | 3/2014 | Bijsterveldt | B27B 17/0008 30/298.4 |
| 8,752,744 | B2 * | 6/2014 | Okouchi | B25F 5/02 224/268 |
| 9,522,464 | B2 * | 12/2016 | Segura | F16M 13/022 |
| 2004/0178240 | A1 * | 9/2004 | Bauer | A45F 5/02 224/268 |
| 2016/0354904 | A1 * | 12/2016 | Dicaire | A45F 5/021 |
| 2019/0337142 | A1 * | 11/2019 | Hays | B25H 3/006 |

* cited by examiner

SYSTEMS AND METHODS FOR FASTENING A COMPONENT TO A BUILDING SUBSTRATE

CROSS-REFERENCE TO RELATED APPLICATIONS

This application claims the benefit of U.S. Provisional Application Ser. No. 62/631,320, filed Feb. 15, 2018, entitled "SYSTEMS AND METHODS FOR FASTENING A COMPONENT TO A BUILDING SUBSTRATE," which is hereby incorporated by reference in its entirety and for all purposes.

BACKGROUND

Field

The present disclosure generally relates to construction, and more specifically to nailing systems and methods.

Description of the Related Art

Trim components, such as trim boards and the like, may be applied to an exterior of a building. Existing methods of attaching trims to a building substrate typically require face nailing, e.g., driving nails through the face of the trims perpendicular to the building substrate. Face nailing of trim boards and the like may undesirably result in relatively low holding power for each nail, requiring a relatively large number of nails to securely fasten the trim to the substrate. Additionally, when nails are driven through the exterior face of a trim, the nail head and/or any associated recess in the trim (e.g., if the nails are countersunk) must be touched up and/or filled with a putty or sealant, and may negatively affect the appearance of the trim.

SUMMARY

The systems, methods, and devices described herein address one or more problems as described above and associated with existing construction systems and methods. The systems, methods and devices described herein have innovative aspects, no single one of which is indispensable or solely responsible for their desirable attributes. Without limiting the scope of the claims, the summary below describes some of the advantageous features.

In one embodiment, a nail gun alignment device is described. The nail gun alignment device comprises an attachment section having a proximal end and a distal end, the proximal end coupleable to a safety contact element coupling of a nail gun; a spacing section contiguous with the attachment section at the distal end of the attachment section, the spacing section extending a first distance parallel to a nailing path of the nail gun when the attachment section is coupled to the safety contact element coupling of the nail gun, the spacing section comprising parallel first and second spacing members; an entry location section coupled to a distal end of the spacing section by an entry angle section, the entry angle section defining an obtuse angle θ relative to the spacing section, the entry location section extending a second distance from the distal end of the spacing section, the entry location section comprising parallel first and second entry location members; and a connecting member coupled to a distal end of the entry location section by a terminal angle section, the terminal angle section defining an angle of approximately 90° relative to the entry location section. The nail gun alignment device facilitates angled nailing of a trim board to a building substrate at a nailing angle $\varphi=\theta-90°$ and a nail entry distance y relative to the building substrate, where y is determined by the length of the first and second entry location members.

In some embodiments, the first and second spacing members, the first and second entry location members, and the connecting member comprises a single integrally formed body.

In some embodiments, the nail gun alignment device comprises a metal.

In some embodiments, at least a portion of the nail gun alignment device is coated with a resilient coating.

In some embodiments, θ is between 120° and 150°.

In some embodiments, the first length is between 0.375" and 0.5".

In some embodiments, the second length is less than or equal to 1".

In some embodiments, the nail gun alignment device is further operable as a nail gun safety contact element.

In some embodiments, the proximal end of the attachment section is sized and shaped in accordance with a standardized safety contact element coupling structure corresponding to the nail gun.

In some embodiments, the connecting member rigidly couples the first entry location member and the second entry location member.

In another embodiment, a nail gun alignment device is described. The nail gun alignment device comprises a proximal section coupleable to a safety contact element coupling of a nail gun, and a distal section fixed relative to the proximal section. The distal section comprises a first surface disposed at a preselected angle relative to a nailing path of the nail gun and a second surface disposed orthogonally relative to the first surface. The nail gun alignment device anchors the nailing path at a fixed nail entry distance and a fixed nailing angle relative to a cladding element when the proximal section is coupled to the safety contact element coupling of the nail gun and the distal section is seated within an angle between the cladding element and a building substrate such that the first surface rests against a sidewall of the cladding element and the second surface rests against the building substrate.

In some embodiments, the cladding element comprises a trim board.

In another embodiment, a method of fastening a trim board to a building substrate is described. The method comprises coupling an alignment guide to a nail gun, the alignment guide comprising an attachment section having a proximal end and a distal end, the proximal end coupleable to a safety contact element coupling of the nail gun; a spacing section contiguous with the attachment section at the distal end of the attachment section, the spacing section extending a first distance parallel to a nailing path of the nail gun when the attachment section is coupled to the safety contact element coupling of the nail gun, the spacing section comprising parallel first and second spacing members; an entry location section coupled to a distal end of the spacing section by an entry angle section, the entry angle section defining an obtuse angle θ relative to the spacing section, the entry location section extending a second distance from the distal end of the spacing section, the entry location section comprising parallel first and second entry location members; and a connecting member coupled to a distal end of the entry location section by a terminal angle section, the terminal angle section defining an angle of approximately 90° relative to the entry location section. The method further comprises positioning the trim board adjacent to the building substrate such that the building substrate and a sidewall of the trim board from an interior angle, positioning the nail gun in proximity to the trim board and the building substrate such that the entry location section and the connecting member seat within the interior angle of the trim board and the building substrate, and actuating the nail gun to drive a nail into the sidewall of the trim board at a nailing angle $\varphi=\theta-90°$ and a nail entry distance y relative to the building substrate, such that a portion of the nail travels through the trim board and into the building substrate.

In some embodiments, positioning the nail gun comprises placing the connecting member against the building substrate and placing the entry location section against the sidewall of the trim board.

In some embodiments, positioning the nail gun further comprises applying a pressure against the nail gun toward the interior angle of the trim board and the building substrate to enable actuation of the nail gun by displacing a muzzle of the nail gun relative to the alignment guide.

In some embodiments, the nailing angle $\varphi$ is between 30° and 60°.

In some embodiments, the nail entry distance y is between 0.375" and 0.5".

In some embodiments, the trim board comprises a second sidewall opposite the sidewall, wherein the building substrate and the second sidewall of the trim board form a second interior angle, and the method further comprises positioning the nail gun in proximity to the trim board and the building substrate such that the entry location section and the connecting member seat within the second interior angle, and actuating the nail gun to drive a second nail into the second sidewall at the nailing angle $\varphi$ and the nail entry distance y relative to the building substrate.

In some embodiments, the method further comprises installing a cladding element onto the building substrate adjacent to the sidewall of the trim board, and applying a linear sealant along an interface between the cladding element and the sidewall of the trim board, wherein the cladding element has a thickness greater than or equal to y such that the entry location of the nail is disposed between the sealant and the building substrate.

In some embodiments, the first and second spacing members, the first and second entry location members, and the connecting member comprises a single integrally formed body.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION

Figure 1A:
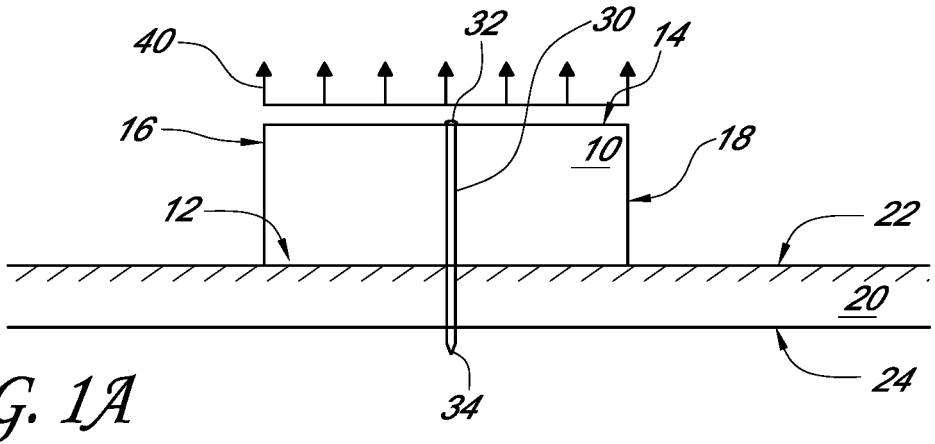
FIG. 1A is a cross sectional view of a trim board attached to a building substrate by face nailing.

Although the present disclosure is described with reference to specific examples, it will be appreciated by those skilled in the art that the present disclosure may be embodied in many other forms. The embodiments discussed herein are merely illustrative and do not limit the scope of the present disclosure.

In the description which follows, like parts are marked throughout the specification and drawings with the same or similar reference numerals. The drawing figures are not necessarily to scale and certain features may be shown exaggerated in scale or in somewhat generalized or schematic form in the interest of clarity and conciseness.

Generally described, this disclosure provides devices and methods for improved installation of trim, such as trim boards or other components, to a building substrate. Trim is typically installed by face nailing trim boards to building substrates. Although angled nailing offers enhanced strength and appearance relative to face nailing, trim typically is not installed with angled nailing techniques because angled nailing is difficult to accomplish consistently and quickly using existing nail gun technology. For example, nail guns typically include a safety contact element that must be depressed in order to drive a nail. The pressure exerted by an operator to depress the safety contact element may cause the nail gun tip to move away from the desired entry location and angle before the nail is driven into the component and/or substrate.

Accordingly, embodiments described herein include alignment devices configured for use with nail guns, such as finish nailers or the like. The alignment devices can be sized and shaped to facilitate repeatable and accurate angled nailing at a desired nailing angle and height above the sheathing or other building substrate to which the trim is being attached. Advantageously, the alignment devices are sized and shaped to stably seat within an angle between a trim board and a building substrate such that a nail gun user can repeatedly drive nails at a regular angle and height through the side of the trim board and into the building substrate to fasten the trim board to the building substrate. Such regular repeated nailing may be accomplished without requiring the user to measure and/or visually determine the height and angle at which the nail will be driven.

In some embodiments, an alignment device includes a spacing section having a length that determines the spacing between the muzzle of the nail gun and the nail entry point, an entry angle section that determines the angle at which the nail will be driven, and an entry location section that determines the height at which the nail will be driven. Accordingly, the muzzle spacing, nailing angle, and entry location achieved by the alignment devices can each be independently selected during manufacturing by altering or selecting a length or angle of the corresponding section of the alignment device. In some embodiments, the alignment device may be configured to facilitate toe nailing and/or skew nailing.

Moreover, the present disclosure provides alignment devices compatible with a wide range of commercially available nail guns. The alignment devices can include an attachment section customized to fit a desired model of nail gun, and it will be appreciated that the attachment sections of any of the alignment devices disclosed herein may be manufactured and/or customized to fit a particular nail gun model.

In one embodiment, an alignment device for a nail gun includes a proximal end and a distal end, the proximal end being sized and shaped to removably couple the alignment device to the nail gun, the distal end being bent at an angle substantially supplementary to the angle formed by the trim sidewall and substrate surface.

In one embodiment, the distal end of the alignment device comprises two exterior surfaces arranged at an angle to each other. In use, the first exterior surface is configured to contact and apply a force to the substrate surface while the second exterior surface is configured to contact and apply a force to the trim sidewall.

In one embodiment, an arm extending from the distal end is oriented at an angle relative to the distal end of the device. The arm in conjunction with the distal end of the device places the nail gun head in a position that would allow insertion of a nail at the desired angle and depth.

These and other advantages of various embodiments will be apparent from the description that follows.

FIG. 1A is a cross sectional view of a trim board 10 attached to a building substrate 20 by face nailing. The trim board 10 includes an interior surface 12, an exterior surface 14, a first side surface 16, and a second side surface 18. The building substrate 20 similarly includes an exterior surface 22 and an interior surface 24. When the trim board 10 is installed or positioned for installation, the interior surface 12 of the trim board 10 is adjacent to and/or abutting the exterior surface 22 of the building substrate 20. The building substrate 20 can be any of various substrates, such as a sheathing (e.g., plywood, oriented strand board, composite materials, etc.), framing members, etc.

In existing face nailing techniques, a nail 30, such as a finish nail or the like, is driven through the exterior surface 14 of the trim board 10 substantially perpendicular to the exterior surface 14 such that the tip 34 of the nail 30 penetrates through the interior surface 12 and into the building substrate 20 through the exterior surface 22 of the building substrate 20. The nail 30 may be driven until the head 32 of the nail 30 is near the exterior surface 14, for example, slightly above the exterior surface 14, flush or level with the exterior surface 14, or slightly indented and/or countersunk beyond the exterior surface 14 within the trim board 10. In various embodiments, the tip 34 may be disposed within the building substrate 20, or may extend beyond the rear surface 24 into a space or additional substrate behind the building substrate 20, depending, for example, on the length of the nail 30, the thickness of the trim board 10 between the interior surface 12 and the exterior surface 14, and/or the thickness of the building substrate 20 between the exterior surface 22 and the interior surface 24. For example, finish nails used to face nail a trim to a plywood or oriented strand board sheathing may be long enough to extend through the interior surface 24.

When a trim board 10 is attached to a building substrate, the trim board 10 may experience an outward force 40 due to wind load, suction pressure, or other outward load directed away from the building substrate 20. Each nail 30 of a face nailed trim board 10 as shown in FIG. 1A may have relatively low holding strength opposing an outward force 40 because the outward force 40 is parallel to the direction in which the nail 30 was driven through the trim board 10 and building substrate 20. Thus, friction between the nail 30 and the building substrate 20 provides the only resistive force opposing withdrawal of a face nailed nail 30. Accordingly, face nailing of an exterior trim board 10 may generally require a relatively large number and/or close spacing of nails 30 or other fasteners in order to ensure the trim board 10 does not move from its installed location. The relatively larger number of nails 30 further results in an increased number of nail heads or nail holes that must be sealed with a sealant after installation.

Figure 1B:
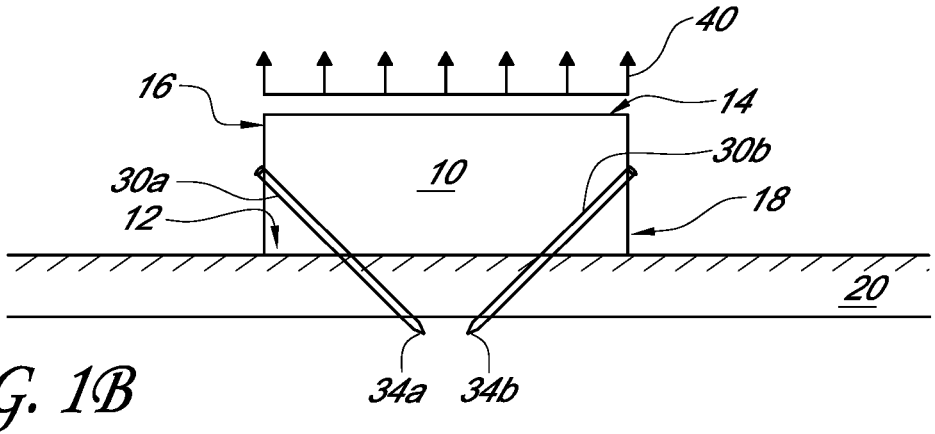
FIG. 1B is a cross sectional view of a trim board attached to a building substrate by angled nailing.

As an alternative to face nailing, angled nailing can provide a more robust attachment method for a trim board 10. FIG. 1B is a cross sectional view of a trim board 10 attached to a building substrate 20 by angled nailing. Similar to the system depicted in FIG. 1A, the trim board 10 of FIG. 1B includes an interior surface 12, an exterior surface 14, a first side surface 16, and a second side surface 18. In the depicted configuration, a first nail 30*a* is driven into the first side surface 16 of the trim board 10 at an inward angle (e.g., toward the interior surface 12), such that the first nail 30*a* extends through the interior surface 12 and at least partially through the building substrate 20. Similarly, a second nail 30*b* is driven into the second side surface 18 of the trim board 10 at an inward angle such that the second nail 30*b* extends through the interior surface 12 and at least partially through the building substrate 20. Accordingly, the outward force 40 is not parallel to either of the nails 30*a*, 30*b*, and is therefore less likely to pull the nails 30*a*, 30*b* out of the trim board 10. In some embodiments, the first and second nails 30*a*, 30*b* may be driven at the same or similar heights and angles relative to the first and second side faces 16, 18.

Figure 1C:
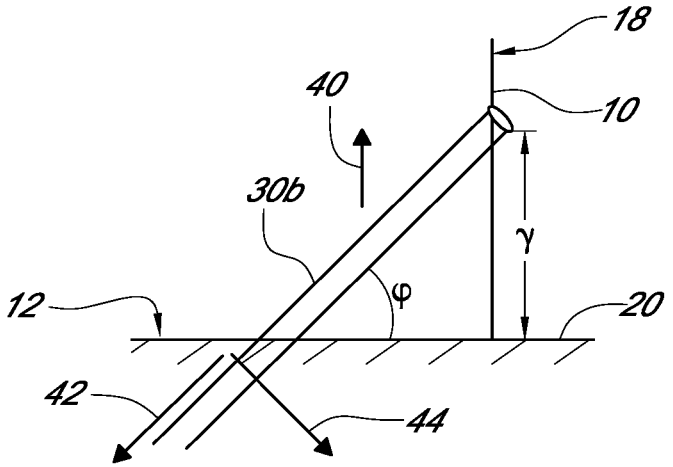
FIG. 1C is a cross sectional view of a portion of the trim board and building substrate of FIG. 1B.

The advantages of angled nailing will become apparent with reference to FIG. 1C, which shows a closer cross sectional view of a portion of the trim board 10 and building substrate 20 of FIG. 1B. As described above, the second nail 30*b* at least partially secures the trim board 10 to the building substrate 20 by extending through the second side face 18 of the trim board 10, the interior face 12 of the trim board 10, and at least partially through the building substrate 20. The location of an angled nail such as the second nail 30*b* can be defined more precisely by a distance y and an angle φ, where y is the distance along the side face 18 between the building substrate 20 and the point at which the nail 30*b* enters the side face 18, and φ is the angle between the nail 30*b* and the interior surface 12 of the trim board 10 (and/or the exterior surface 22 of the building substrate 20).

Accordingly, when an outward force 40 is applied to the angle nailed trim board 10, the outward force 40 is opposed by parallel components (e.g., the components perpendicular to the building substrate 20 and parallel to the outward force 40) of both a substrate friction force 42 between the building substrate 20 and the nail 30*b*, and a substrate normal force 44 between the building substrate 20 and the nail 30*b*. The substrate friction 42 is directed along the nail 30*b* and is generally proportional to the substrate normal force 44. For example, the substrate friction 42 may be defined by the equation $F_f = \mu F_N + f$, where $F_f$ is the substrate friction force 42, μ is the coefficient of friction between the building substrate 20 and the nail 30*b*, $F_N$ is the substrate normal force 44, and f is a friction constant associated with the nail 30*b*. Accordingly, the trim board 10 will not be moved from its fastened position unless the total tributary outward force 40 is greater than the sum of the substrate friction 42 and the substrate normal force 44.

Moreover, referring again to FIG. 1B, the angle nailed configuration is especially robust to nail withdrawal and/or movement of the trim board 10 because a force exerted on the trim board 10 will necessarily create some amount of shearing force. For example, a force directed along the direction of the second nail 30*b* (e.g., at the angle φ relative to the exterior surface 14) would result in a shearing force on the first nail 30*a* in addition to frictional resistance to withdrawal of the second nail 30*b*. Thus, there is no withdrawal direction that results in only frictional resistances. Accordingly, a trim board 10 may be securely fastened to a building substrate 20 by substantially fewer nails along the length of the trim board 10 than would be required for secure attachment with face nailing.

Although angled nailing provides a more secure attachment method for trim, angled nailing of exterior trim to a building substrate can be difficult, tedious, and/or inexact using existing methods. For example, exterior trim is frequently installed using nail guns. When using a nail gun, the insertion location and angle are generally determined visually by positioning of the nail gun. In the case of face nailing, such approximation may provide sufficient accuracy where the nail is to be driven substantially perpendicularly through a relatively wide exterior face of a trim board. However, it may be difficult to reliably nail trim with angled fasteners using a nail gun because greater precision of the nail insertion location and angle. For example, in the configuration shown in FIG. 1C, it may be desired to drive the nail 30*b* at a distance y of between 0.1" and 1", between 0.375" and 0.75", between 0.375" and 0.5", or another particular range, and at an angle φ between 30° and 60°. In certain implementations, a nailing angle between 30° and 60° may desirably result in minimal penetration failures as the nails 30*a*, 30*b* are driven into the trim board 10 and the building substrate 20. In another example, driving a 2.0" to 2.5 " 15-gauge finish nail at a distance y between 0.375" and 0.75" from the building substrate 20 (e.g., a plywood or oriented strand board sheathing) can provide a desirably secure penetration depth into the building substrate 20 and the trim 10 for reliable per-fastener holding power. In yet another example, driving a nail at a distance y between 0.375" and 0.5" from the building substrate 20 may cause the head of the nail to be close enough to the building substrate 20 that the nail head can be covered by caulk or flashing during the installation process, such that additional touch up is not required. Given a desired range of y and φ, it may be difficult and/or time-consuming to accurately nail trim boards with an angled nailing technique using existing nail gun devices. As will now be described, efficient, accurate, and repeatable angled nailing of trims may be achieved using the nail gun alignment devices described herein.

FIGS. 2A-2E depict a nail gun alignment device 100 configured to facilitate angled nailing. Referring jointly to FIGS. 2A-2E, the alignment device 100 generally comprises a contiguous body including an attachment section 150 comprising a first attachment member 150*a* and a second attachment member 150*b* (FIG. 2E), a spacing section 160 comprising a first spacing member 160*a* and a second spacing member 160*b*, an entry location section 170 comprising a first entry location member 170*a* and a second entry location member 170*b*, and a connecting member 180. The spacing section 160 and the entry location section 170 are joined by an entry angle section 165 including a first angle member 165*a* and a second angle member 165*b*. The connecting member 180 is joined to the entry location section 170 by a terminal angle section 175 comprising a first terminal angle member 175*a* and a second terminal angle member 175*b*. The configuration depicted in FIGS. 2A-2E provides an unobstructed nailing path 101 between the various first members 150*a*, 160*a*, 165*a*, 170*a*, 175*a* and the various second members 150*b*, 160*b*, 165*b*, 170*b*, 175*b*.

Figure 2A:
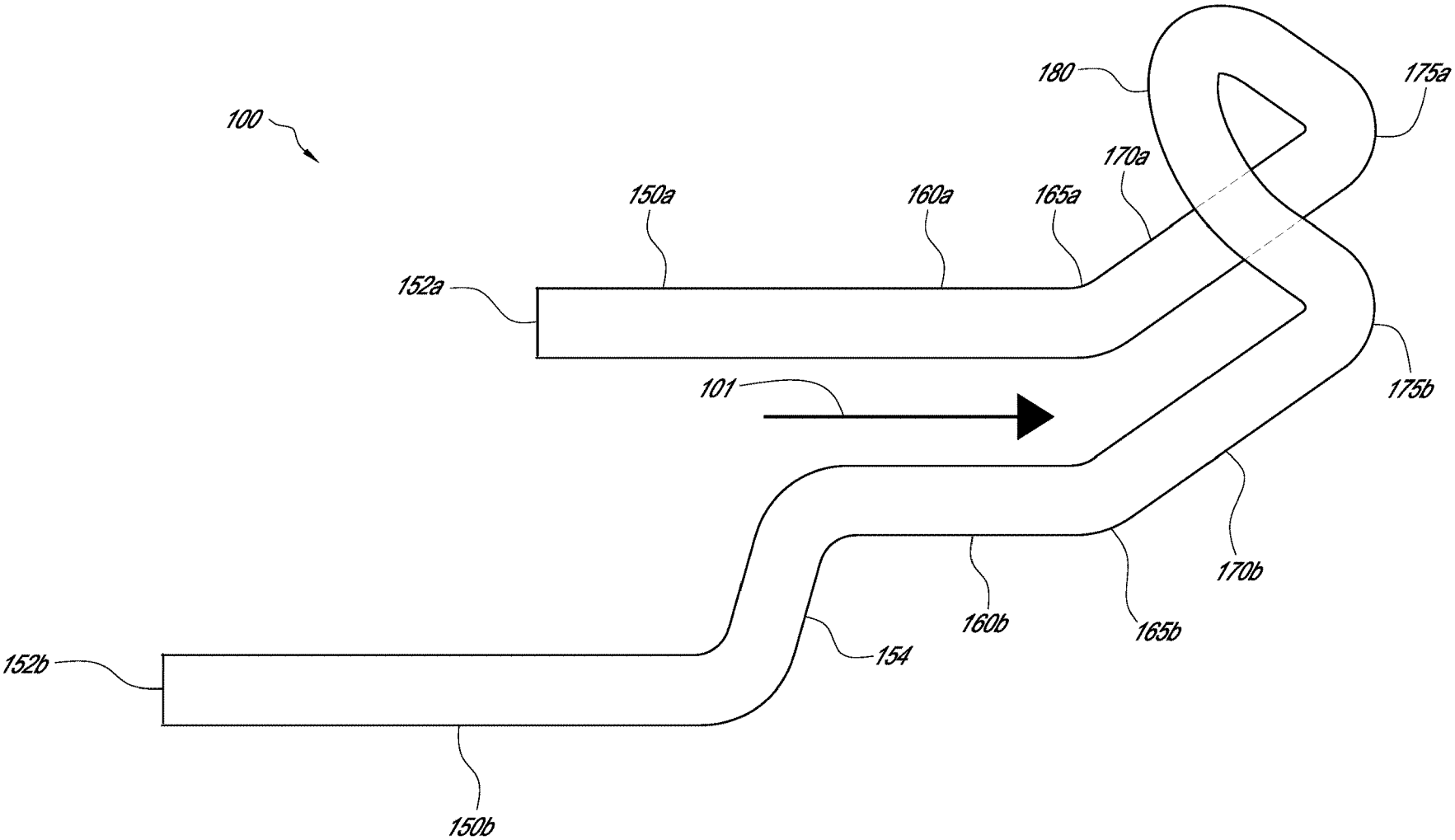
FIG. 2A is a perspective view of a nail gun alignment device configured to facilitate angled nailing in accordance with an example embodiment.
Figure 2C:
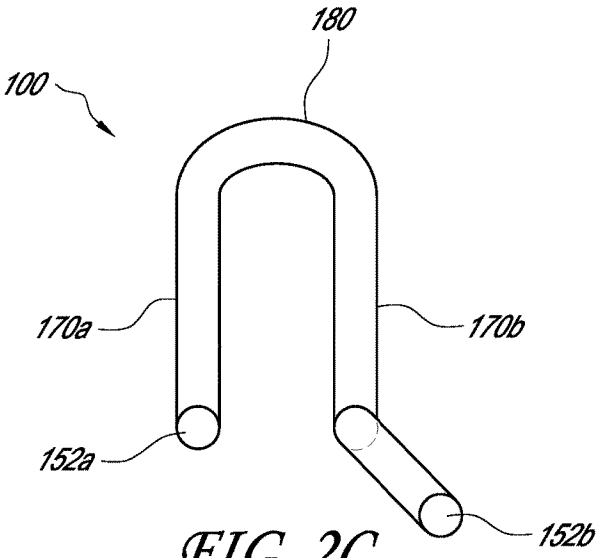
FIG. 2C is a rear elevation view of the alignment device of FIGS. 2A and 2B.
Figure 2B:
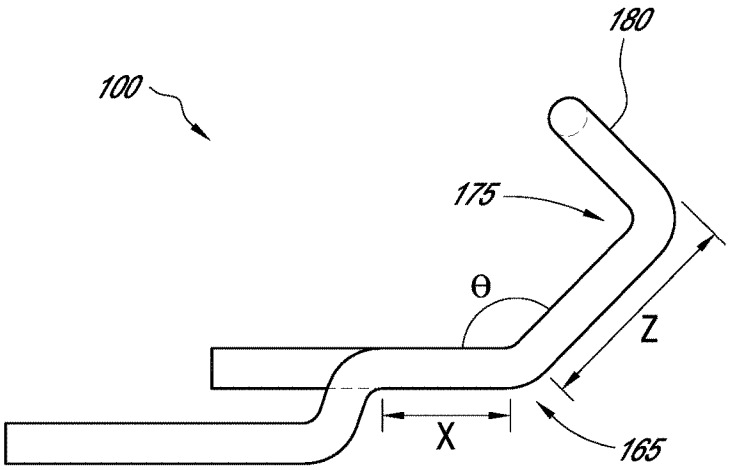
FIG. 2B is a side elevation view of the alignment device of FIG. 2A.
Figure 2E:
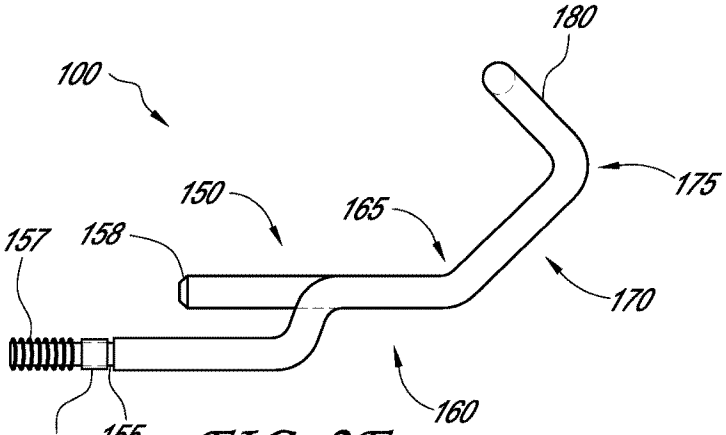
FIG. 2E is a side elevation view of the alignment device of FIGS. 2A-2D including an alternative coupling member configuration.
Figure 2D:
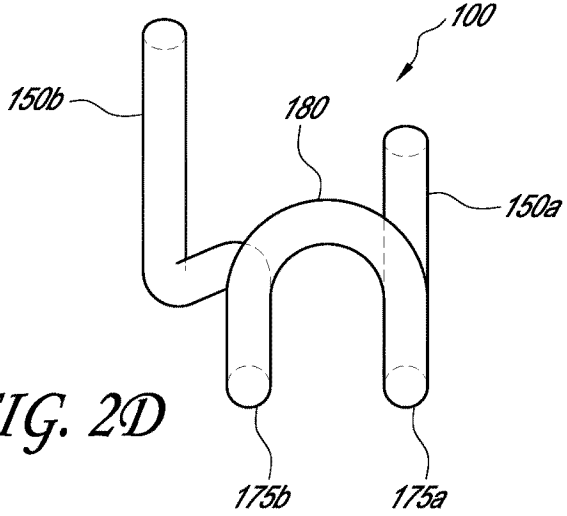
FIG. 2D is a front elevation view of the alignment device of FIGS. 2A-2C.

The attachment section 150 is configured to secure the alignment device 100 to a nail gun. In some embodiments, the alignment device 100 can be used in place of, and may be configured to function as, a pressure-activated safety lever, push lever, safety contact, or other contact element of various commercially available nail guns. Accordingly, the orientation, size, shape, and/or relative spacing of the first attachment member 150*a* and the second attachment member 150*b* may be selected to be compatible with a particular model of nail gun to be used. For example, the attachment section 150 may be sized and shaped to comply with one or more industry, manufacturer, and/or product-specific standard contact element attachment structures. Thus, as shown in FIGS. 2A and 2E, some embodiments of the alignment device 100 may include components such as one or more of an s-bend 154, a recess 155, a protrusion 156, a threaded section 157, and/or a bevel 158, as necessary to conform to a safety lever or push lever receiving component of a particular nail gun model. The attachment section 150 terminates at first and second ends 152*a*, 152*b*.

The spacing section 160 between the attachment section 150 and the entry angle section 165 provides for a separation along the nailing path 101 between the nail gun and the nail entry location. The spacing section 160 is generally defined by a length x of the first and second spacing members 160*a*, 160*b*. The length x of the spacing section 160 can be selected, for example, based on requirements of the nail gun, to achieve clearance between the nail gun and the trim or building substrate, and/or to provide a sufficient distance between the trim and the nail gun for safe and/or proper operation. In some embodiments, the length of the spacing section 160 can be, for example, between 0.25" and 1 inch, between 0.375" and 0.5", or other suitable range. In one particular example, the length of the spacing section can be approximately 0.469".

The entry angle section 165 between the spacing section 160 and the entry location section 170 provides for a desired nailing angle φ, as defined and described with reference to FIG. 1C. The entry angle section 165 is generally defined by an angle θ between the spacing section 160 and the entry location section 170 (e.g., the angle formed between the first spacing member 160*a* and the first entry location member 170*a*, and/or between the second spacing member 160*b* and the second entry location member 170*b*). As will be described in greater detail with reference to FIGS. 4A-4F, the angle θ can be selected based on the desired nailing angle φ, where $\theta=90°+\varphi$. In some embodiments, the angle θ can be between 90° and 180°, between 120° and 150°, or other suitable range. In one particular example, the angle θ can be approximately 45°.

The entry location section 170 between entry angle section 165 and the terminal angle section 175 provides for a desired distance y between the nail entry location and the building substrate, as defined and described with reference to FIG. 1C. The entry location section 170 is generally defined by a length z of the first and second entry location members 170*a*, 170*b*. The length z of the entry location section 170 can be selected based on the desired distance y of FIG. 1C, for example, based at least in part on one or more of the trim board material, the building substrate material, the trim board width or thickness, and/or the thickness of the building substrate to be used. In some embodiments, the length z can be between 0" and 1", between 0.1" and 0.75", between 0.375" and 0.75", between 0.375" and 0.5", or other suitable range. In one particular example, the length z can be approximately 0.916".

The terminal angle section 175 and connecting member 180 are provided to connect and fix the various first members 150*a*, 160*a*, 165*a*, 170*a* relative to the various second members 150*b*, 160*b*, 165*b*, 170*b*. Connection between the various first members 150*a*, 160*a*, 165*a*, 170*a* and second members 150*b*, 160*b*, 165*b*, 170*b* provides additional dimensional stability to the alignment device 100 and allows the alignment device 100 to remain as a single piece when not attached to a nail gun. Additionally, the terminal angle section 175 and connecting member 180 form an angled portion of the alignment device 100 that can be seated within the junction of a building substrate and a trim board to stabilize the alignment device 100 and an attached nail gun for nail driving. For example, a terminal angle section having an angle of approximately 90° may be suitable for installing trim boards having a substantially rectangular cross section, as such trim boards form an interior angle of approximately 90° at their junction with an adjacent building substrate. Angles other than 90° may be suitable for installing trim boards having a trapezoidal or parallelogrammatic cross section. The length of the connecting member 180 may be selected as desired to provide stability for the guide device 100 and/or a nail gun coupled to the guide device 100. For example, in some embodiments, the connecting member 180 may extend to a maximum distance of approximately 0.3", 0.425", 0.5", 0.75", or another suitable distance from the terminal angle section 175.

The alignment device 100 may be made from any suitably rigid material. For example, the alignment device 100 may comprise a metal, such as steel, aluminum, brass, or other metals or alloys. In some embodiments, the alignment device 100 may comprise one or more plastics, polymeric materials, composite materials, or the like. In further embodiments, the alignment device 100 may comprise an integrally formed metal structure at least partially covered in a resilient coating, such as a plastic coating, a rubberized coating, a paint, a polymeric material, a composite material, or the like. For example, in some embodiments the spacing section 160, the entry angle section 165, the entry location section 170, the terminal angle section 175, and the connecting member 180 may be covered in a rubberized or other coating, while the attachment section 150 may comprise a bare or non-coated metal to provide for secure attachment to a nail gun.

Figure 3:
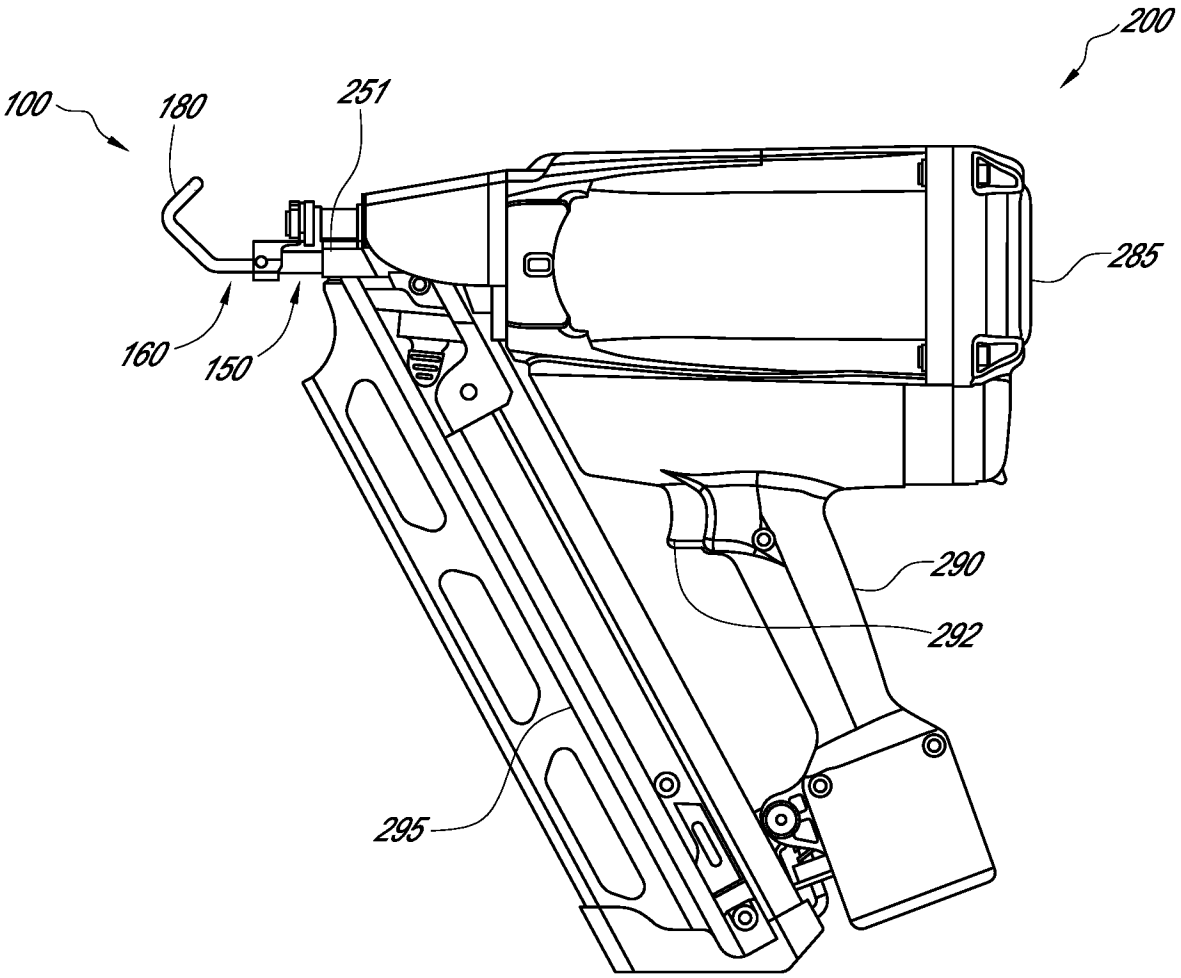
FIG. 3 depicts an operational configuration of the alignment device of FIGS. 2A-2E coupled to a nail gun.

FIG. 3 depicts an operational configuration of the alignment device 100 of FIGS. 2A-2E coupled to a nail gun 200. The nail gun 200 may be any type of commercially available nail gun suitable for attaching trim to a building substrate. For example, the nail gun 200 may comprise one or more of a finishing nail gun, a brad nail gun, a framing nail gun, an angle nail gun, or the like. The nail gun 200 may further be one or more of a pneumatic nail gun, a powder-actuated nail gun, a combustion powered nail gun, an electric nail gun, a solenoid-powered nail gun, or other actuation type. The nail gun 200 can include a body 285, a handle 290, a trigger 292, a magazine 295, and a safety contact element coupling 251 configured to receive a conventional safety contact element (e.g., a push lever or the like).

As described with reference to FIGS. 2A-2E, the attachment section 150 of the alignment device 100 is configured to be received by the safety contact element coupling 251 of the nail gun 200. Accordingly, the alignment device 100 is coupled to the nail gun 200 by inserting and securing the alignment device 100 in place of a removable safety contact element of the nail gun 200, such that the spacing section 160 is located proximal to the body 285 of the nail gun 200, and the remaining portions of the alignment device 100 including the connecting member 180 are located distal from the body 285. Moreover, the alignment device 100 is interchangeable, such that it can be removed and replaced with the original safety contact element if the nail gun 200 is to be used for face nailing or any other nailing applications.

The nail gun 200 is configured to store one or more nails within the magazine 295. An uppermost nail within the magazine 295 can be driven by an actuating means (e.g., pneumatic pressure, a solenoid, an explosive powder, electromagnetic force generator, or the like) within the body 285. Driving of the nail can be caused by a user holding the handle 290 and depressing the trigger 292. Typically, nail guns may require that both a contact element and the trigger be depressed to drive a nail, for example, as a safety interlock to prevent the firing of a nail when the nail gun is not positioned against a substrate for nailing. Thus, the alignment device 100 may function both to align the nail driving location and as a safety contact element. For example, the nail gun 200 can be capable of driving a nail when the alignment device 100 is displaced toward the body 285 of the nail gun along the nail driving axis parallel to the spacing section 160. Advantageously, the angled configuration of the spacing section 160 relative to the entry location section 170 and the spacing member 180 maintains the same entry location and nailing angle regardless of how far the alignment device 100 is displaced parallel to the spacing section 160 to allow the nail gun 200 to drive the nail.

With reference to FIGS. 4A-4F, an example process of nailing a trim board to a building substrate, using a nail gun with the alignment devices disclosed herein, will now be described. Although the process is depicted and described with reference to nailing a trim board to a building substrate, it will be appreciated that the process may equally be applied to nail other combinations of components. FIGS. 4A-4F may be, for example, top or bottom plan views if a vertical trim board is being installed, or may be side views if a horizontal trim board is being installed.

Figure 4A:
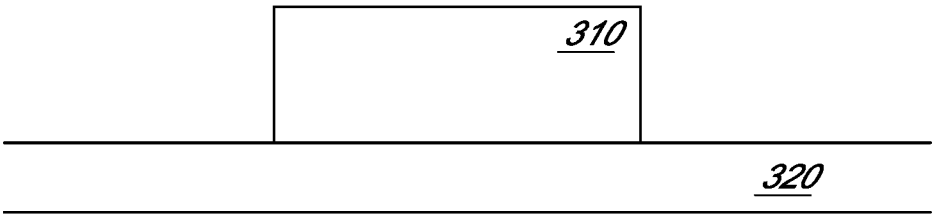
FIGS. 4A-4F depict an example process of nailing a trim board to a building substrate using a nail gun with the alignment device of FIGS. 2A-2E.

The process begins in the configuration depicted in FIG. 4A, in which a trim board 310 is positioned adjacent to a building substrate 320, such as a sheathing. The trim board 310 is located in a position and orientation as desired for attachment as a trim. For example, the trim board 310 may be placed adjacent to a region of an exterior building substrate to which a cladding will be applied. In some embodiments, the trim board 310 may be placed adjacent to a region of cladding that has already been installed. In the configuration of FIG. 4A, the trim board 310 is ready to be nailed to the building substrate.

Figure 4B:
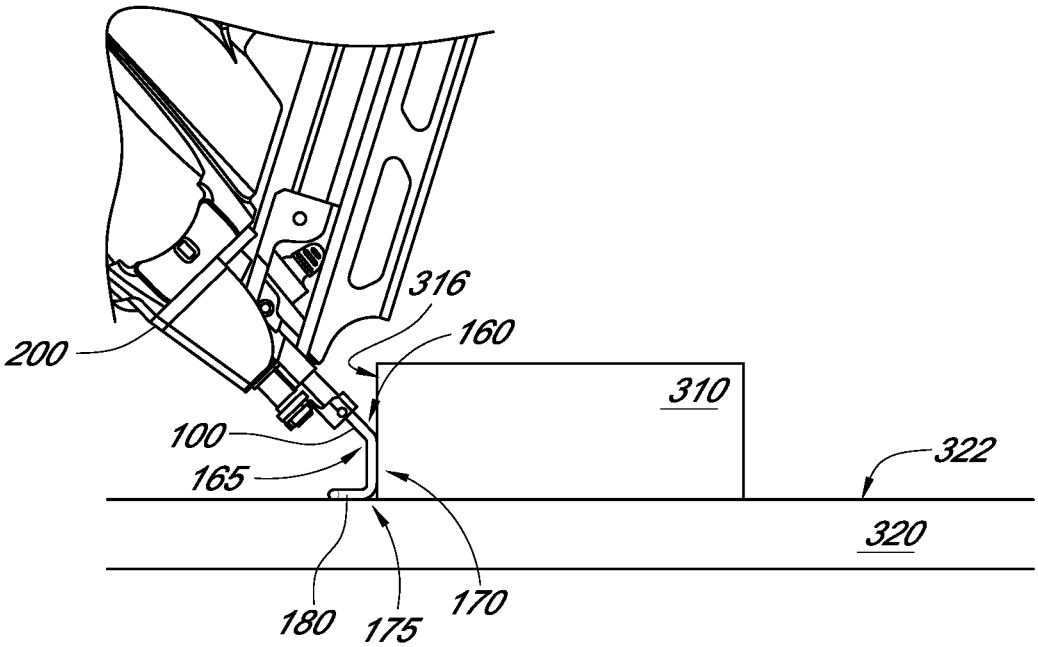

The process continues to the configuration depicted in FIG. 4B, in which the nail gun 200 is placed into position for nailing. The alignment device 100 is coupled to the nail gun 200 in place of the safety contact element. In the position of FIG. 4B, the nail gun 200 is positioned such that the alignment device 100 is stably seated within the junction between the trim board 310 and the building substrate 320. The entry location section 170 sits adjacent and parallel to the first side surface 316 of the trim board 310. The connecting member 180 sits adjacent and parallel to the exterior surface 322 of the building substrate 320, such that the terminal angle section 175 seats within and matches the interior angle formed between the exterior surface 322 of the building substrate and the first side surface 316 of the trim board 310. The muzzle of the nail gun 200 is spaced from the first side surface 316 by an appropriate distance determined by the length of the spacing section 160, as described above with reference to FIGS. 2A-2E.

Figure 4C:
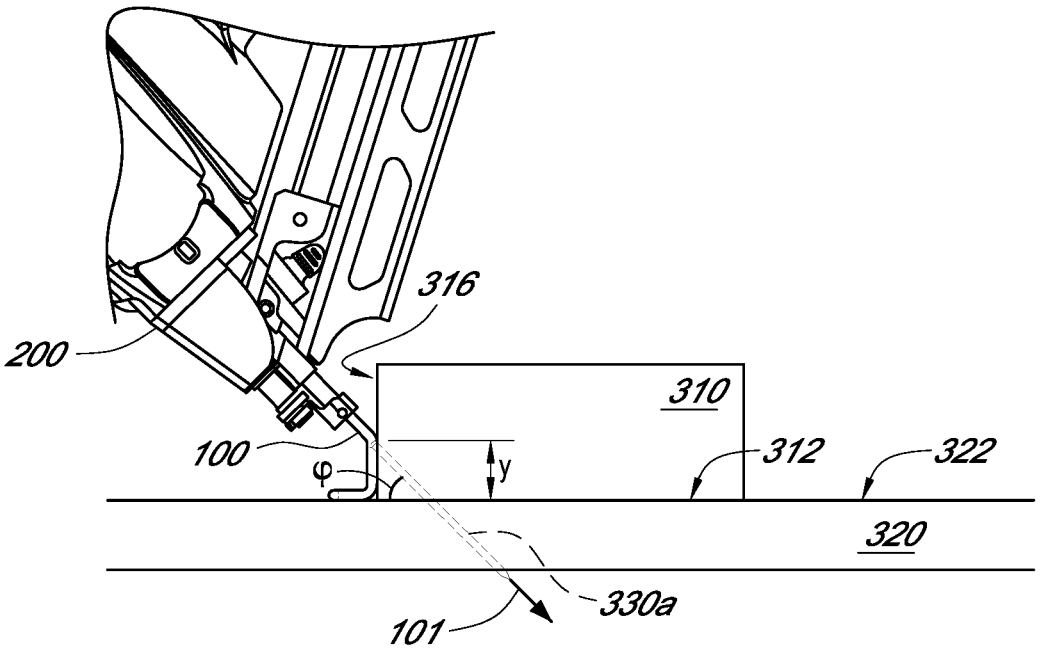

The process continues to the configuration depicted in FIG. 4C, as a first nail 330*a* is driven by the nail gun to at least partially secure the trim board 310 to the building substrate. The first nail 330*a* is driven by applying a pressure to the nail gun 200 along the direction of nailing path 101 and depressing the trigger of the nail gun to drive the first nail 330*a* out of the nail gun 200 and into the trim board 310 and building substrate 320 along the nailing path 101. The first nail 330*a* enters the trim board 310 at the distance y above the building substrate 320 as determined by the length of the entry location section 170 of the alignment device 100. In addition, the first nail 330*a* is driven at the desired angle φ relative to the building substrate 320 as determined by the angle θ of the entry angle section 165. As the first nail 330*a* is driven by the nail gun 200, it passes through at least the first side surface 316 of the trim board 310, the interior surface 312 of the trim board, and the exterior surface 322 of the building substrate 320 to anchor the trim board 310 to the building substrate 320.

Figure 4D:
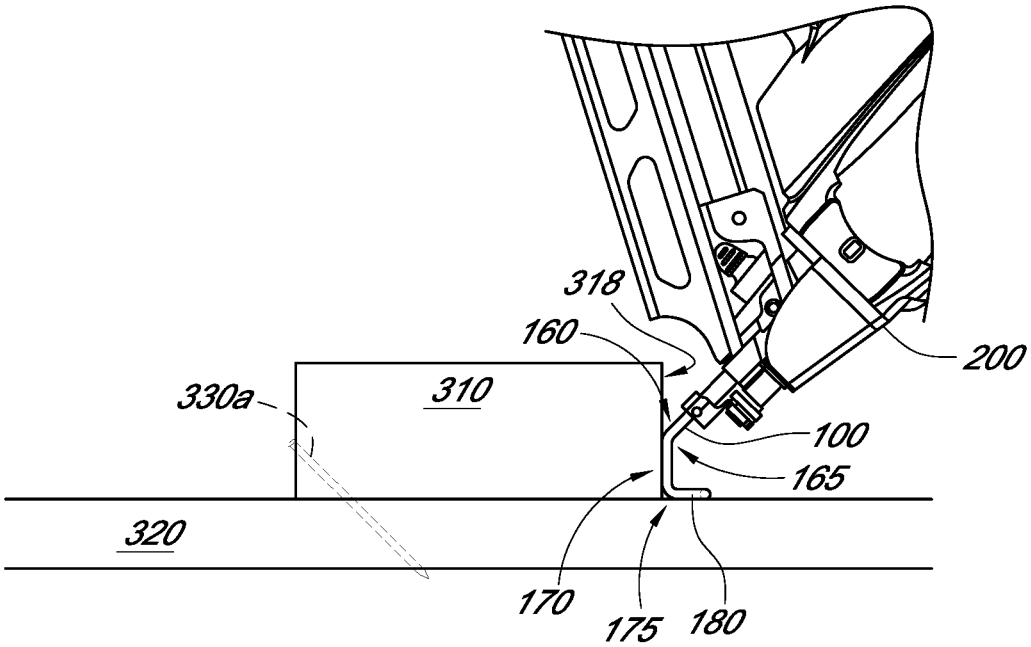

After the first nail 330*a* is driven into the trim board 310 and building substrate 320, the process continues to the configuration depicted in FIG. 4D. As shown in FIG. 4D, the nail gun 200 and alignment device 100 have been moved to a position adjacent to the second side 318 of the trim board 310. Similar to the configuration of FIG. 4B, the entry location section 170 sits adjacent and parallel to the second side surface 318 of the trim board 310, and the connecting member 180 sits adjacent and parallel to the exterior surface 322 of the building substrate 320, such that the terminal angle section 175 seats within and matches the interior angle formed between the exterior surface 322 of the building substrate and the second side surface 318 of the trim board 310. The trim board 310 remains at least partially secured to the building substrate 320 by the first nail 330*a*. The position of the nail gun 200 in FIG. 4D may be directly across the trim board 310 from the first nail 330*a*, or may be displaced along the length of the trim board 310 relative to the first nail 330*a*.

Figure 4E:
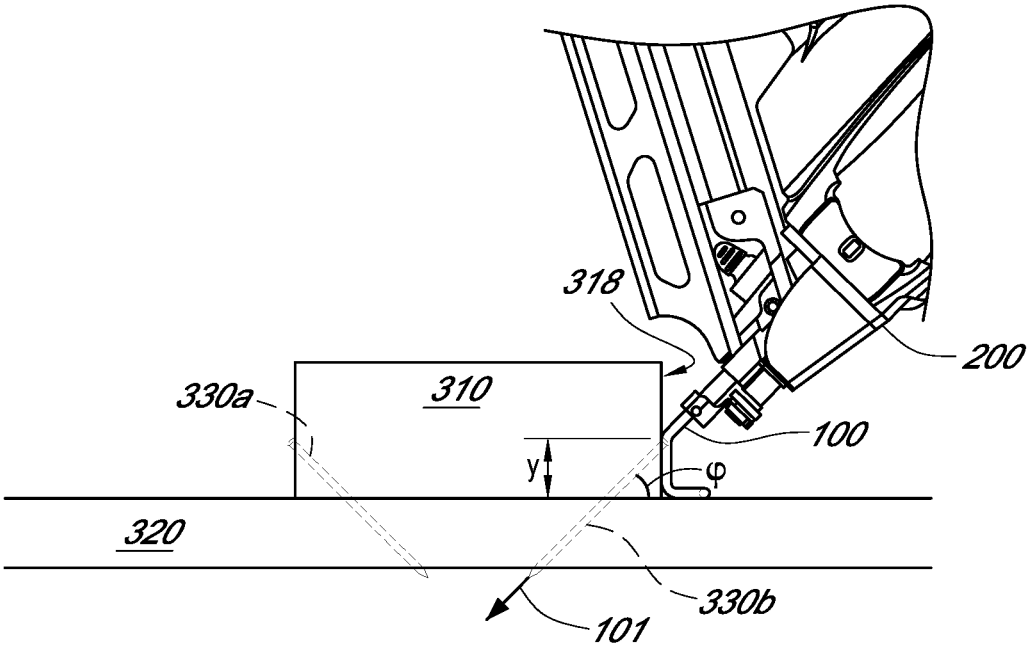

The process continues to the configuration depicted in FIG. 4E. Similar to the driving of the first nail 330*a*, a second nail 330*b* is driven by engaging the alignment device 100 as a safety contact element and depressing the trigger of the nail gun 200. Accordingly, the second nail 330*b* is driven into the second side surface 318 of the trim board 310 at the desired distance y and the desired angle φ relative to the building substrate 320. After the second nail 330*b* is driven, the nail gun and alignment device 100 may be removed to yield the configuration depicted in FIG. 4F.

Figure 4F:
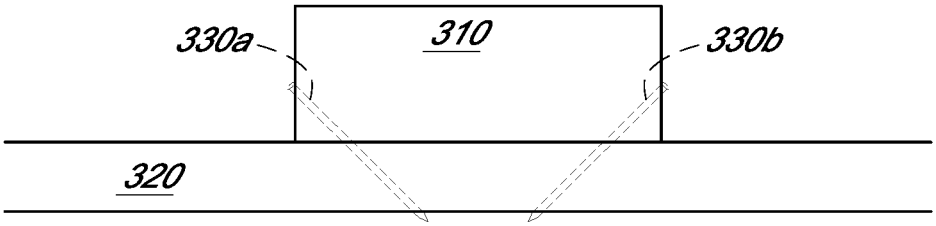

FIG. 4F depicts the finished nailing configuration consistent with the configuration depicted in FIG. 1B. The process of FIGS. 4A-4F may be repeated any number of times as desired (e.g., at a plurality of locations spaced along the length of the trim board 310) to further secure the trim board 310 to the building substrate 320 and/or to secure additional trim components to the building substrate 320 or other substrates. It will be appreciated that many of the advantageous features of the alignment device 100 permit the process of FIGS. 4A-4F to be repeated quickly and reliably, with all nails being driven at approximately the desired entry distance y and angle φ relative to the building substrate 320. Advantageously, the perpendicular entry location section 170 and connecting member 180 permit the combined nail gun 200 and alignment device 100 to be securely seated between the trim board 310 and the building substrate 320 by exerting a single pressing force roughly along the nailing path. Thus, a nail gun user may quickly and accurately place each nail 330*a*, 330*b* without having to carefully measure a distance above the building substrate 320 and manually position the nail gun 200 at the desired angle.

Figure 5A:
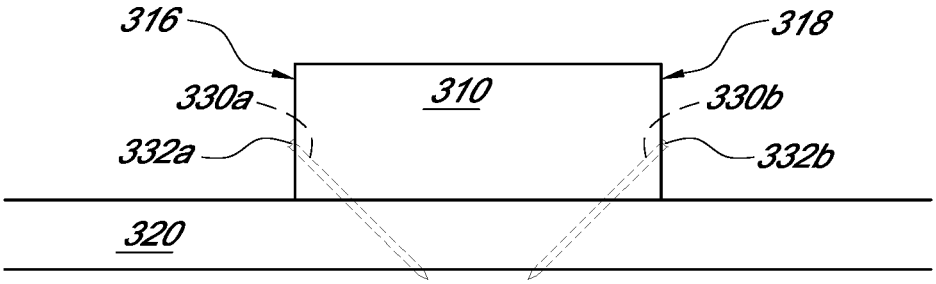
FIGS. 5A-5C depict an example process of installing cladding to a building substrate adjacent to an angle nailed trim board.
Figure 5B:
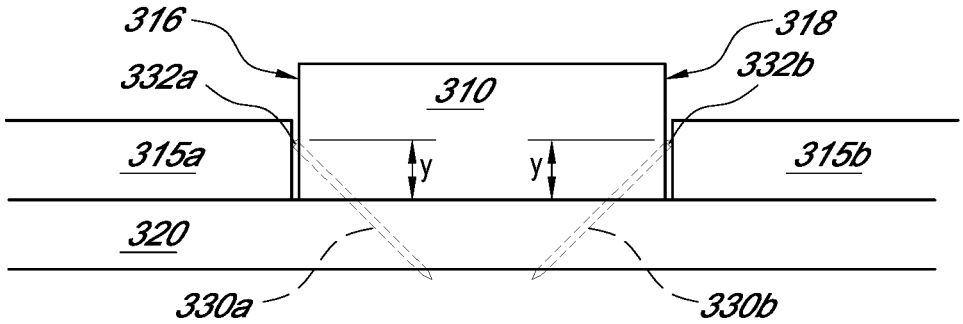
Figure 5C:
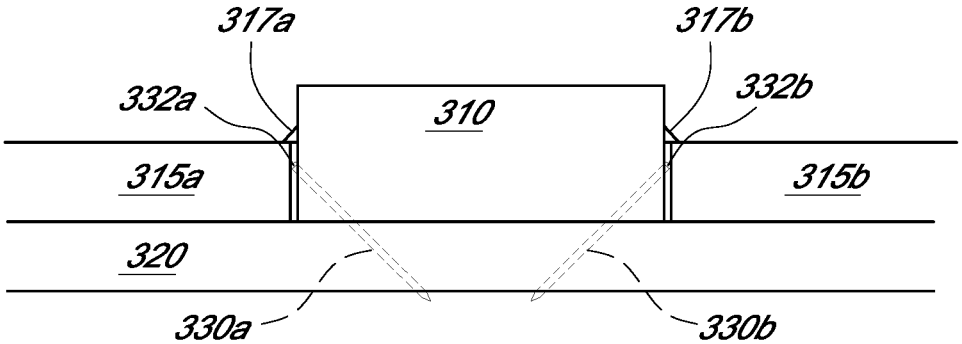

With reference to FIGS. 5A-5C, a further advantage of the nailing systems and methods disclosed herein will be described. FIGS. 5A-5C depict an example process of installing cladding elements 315*a*, 315*b* to a building substrate 320 adjacent to a trim board 310 that has been attached by an angled nailing method. The process begins at FIG. 5A with the trim board 310 secured to the building substrate 320 by nailing, for example, as described with reference to FIGS. 4A-4F. A first nail 330*a* has been driven through the trim board 310 and the building substrate at an angle such that the head 332*a* of the first nail 330*a* is substantially aligned with the first side surface 316 of the trim board 310 (e.g., the head 332*a* may be slightly protruding, flush, or slightly indented relative to the first side surface 316). Similarly, a second nail 330*b* has been driven through the trim board 310 and the building substrate 320 at an angle such that the head 332*b* of the second nail 330*b* is substantially aligned with the second side surface 318 of the trim board 310.

In FIG. 5B, a first cladding element 315*a* has been placed adjacent to the building substrate 320 in proximity to the first side surface 316 of the trim board 310. Similarly, a second cladding element 315*b* has been placed adjacent to the building substrate 320 in proximity to the second side surface 318 of the trim board 310. The cladding elements 315*a*, 315*b* can be secured to the building substrate 320 by any of various well-known securing methods, such as by one or more mechanical fasteners. As shown in FIG. 5B, the nails 330*a*, 330*b* have been driven into the trim board 310 at a distance y from the building substrate 320 that is shorter than the thickness of the cladding elements 315*a*, 315*b*. In some embodiments, the distance y may be approximately equal to or slightly greater than the thickness of the cladding elements 315*a*, 315*b*.

As shown in FIG. 5C, a typical cladding installation may include applying caulk or other sealant at the interface between cladding and trim. Thus, a first caulk line 317*a* or other sealant is applied at the corner between the trim board 310 and the first cladding element 315*a*, and a second caulk line 317*b* or other sealant is applied at the corner between the trim board 310 and the second cladding element 315*b*. Because the distance y is shorter than or approximately equal to the thickness of the cladding elements 315*a*, 315*b*, the nail heads 332*a*, 332*b*, and associated entry holes in the side surface of the trim board 310, are located below the caulk line or are directly covered by the caulk line. Advantageously, this positioning allows the trim board 310 and cladding elements 315*a*, 315*b* to be installed without requiring any nail holes to be filled, sealed, touched up, and/or repainted as would be required if the trim board 310 were attached to the building substrate 320 by face nailing. The use of the alignment device 100 to establish a uniform nailing distance y when fastening the trim board 310 ensures that all of the nails 330*a*, 330*b* (and additional nails driven at further locations along the length of the trim board) will be reliably located at or below the caulk lines 317*a*, 317*b*, significantly enhancing the aesthetic appearance of the trim board 310 and eliminating the need of a nail hole touch-up step during the installation.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used for mounting of trim boards to building substrates and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A nail gun alignment device comprising:

an attachment section having a proximal end and a distal end, the proximal end coupleable to a safety contact element coupling of a nail gun;

a spacing section contiguous with the attachment section at the distal end of the attachment section, the spacing section extending a first distance parallel to a nailing path when the attachment section is coupled to the safety contact element coupling of the nail gun, the spacing section comprising parallel first and second spacing members;

an entry location section coupled to a distal end of the spacing section by an entry angle section, the entry angle section defining an obtuse angle θ relative to the spacing section, the entry location section extending a second distance from the distal end of the spacing section, the entry location section comprising parallel first and second entry location members; and a connecting member coupled to a distal end of the entry location section by a terminal angle section, the terminal angle section defining an angle of approximately 90° relative to the entry location section;

wherein the nail gun alignment device facilitates angled nailing at a nailing angle $\varphi=\theta-90°$ and at a nail entry distance y, where y is determined by the length of the first and second entry location members.

2. The nail gun alignment device of claim 1, wherein the first and second spacing members, the first and second entry location members, and the connecting member comprises a single integrally formed body.

3. The nail gun alignment device of claim 1, wherein the nail gun alignment device comprises a metal.

4. The nail gun alignment device of claim 3, wherein at least a portion of the nail gun alignment device is coated with a resilient coating.

5. The nail gun alignment device of claim 1, wherein 0 is between 120° and 150°.

6. The nail gun alignment device of claim 1, wherein the first length is between 0.375" and 0.5".

7. The nail gun alignment device of claim 1, wherein the second length is less than or equal to 1".

8. The nail gun alignment device of claim 1, wherein the nail gun alignment device is further operable as a nail gun safety contact element.

9. The nail gun alignment device of claim 1, wherein the proximal end of the attachment section is sized and shaped in accordance with a standardized nail gun safety contact element coupling structure.

10. The nail gun alignment device of claim 1, wherein the connecting member rigidly couples the first entry location member and the second entry location member.

11. A method of fastening a trim board to a building substrate, the method comprising:

coupling an alignment guide to a nail gun, the alignment guide comprising:

an attachment section having a proximal end and a distal end, the proximal end coupleable to a safety contact element coupling of the nail gun;

a spacing section contiguous with the attachment section at the distal end of the attachment section, the spacing section extending a first distance parallel to a nailing path of the nail gun when the attachment section is coupled to the safety contact element coupling of the nail gun, the spacing section comprising parallel first and second spacing members;

an entry location section coupled to a distal end of the spacing section by an entry angle section, the entry angle section defining an obtuse angle θ relative to the spacing section, the entry location section extending a second distance from the distal end of the spacing section, the entry location section comprising parallel first and second entry location members; and a connecting member coupled to a distal end of the entry location section by a terminal angle section, the terminal angle section defining an angle of approximately 90° relative to the entry location section;

positioning the trim board adjacent to the building substrate such that the building substrate and a sidewall of the trim board from an interior angle;

positioning the nail gun in proximity to the trim board and the building substrate such that the entry location section and the connecting member seat within the interior angle of the trim board and the building substrate; and actuating the nail gun to drive a nail into the sidewall of the trim board at a nailing angle $\varphi=\theta-90°$ and a nail entry distance y relative to the building substrate, such that a portion of the nail travels through the trim board and into the building substrate.

12. The method of claim 11, wherein positioning the nail gun comprises placing the connecting member against the building substrate and placing the entry location section against the sidewall of the trim board.

13. The method of claim 12, wherein positioning the nail gun further comprises applying a pressure against the nail gun toward the interior angle of the trim board and the building substrate to enable actuation of the nail gun by displacing a muzzle of the nail gun relative to the alignment guide.

14. The method of claim 11, wherein the nailing angle φ is between 30° and 60°.

15. The method of claim 11, wherein the nail entry distance y is between 0.375" and 0.5".

16. The method of claim 11, wherein the trim board comprises a second sidewall opposite the sidewall, wherein the building substrate and the second sidewall of the trim board form a second interior angle, the method further comprising:

positioning the nail gun in proximity to the trim board and the building substrate such that the entry location section and the connecting member seat within the second interior angle; and actuating the nail gun to drive a second nail into the second sidewall at the nailing angle φ and the nail entry distance y relative to the building substrate.

17. The method of claim 11, further comprising:

installing a cladding element onto the building substrate adjacent to the sidewall of the trim board; and applying a linear sealant along an interface between the cladding element and the sidewall of the trim board;

wherein the cladding element has a thickness greater than or equal to y such that the entry location of the nail is disposed between the sealant and the building substrate.

18. The method of claim 11, wherein the first and second spacing members, the first and second entry location members, and the connecting member comprises a single integrally formed body.

* * * * *